United States Patent [19]

Wahl

[11] 4,257,434

[45] Mar. 24, 1981

[54] HEATED HAIR CURLING BRUSH

[76] Inventor: John Wahl, 1701 Locust St., Sterling, Ill. 61081

[21] Appl. No.: 56,256

[22] Filed: Jul. 10, 1979

[51] Int. Cl.[3] ..... A45D 2/36

[52] U.S. Cl. ..... 132/33 R; 15/201; 132/39

[58] Field of Search ..... 132/33 R, 39, 34 R, 132/34 B; 15/201, 202, 194, 191 R

[56] References Cited

U.S. PATENT DOCUMENTS

| | | | |
|---|---|---|---|
| 2,496,010 | 1/1950 | Lotters | 15/201 |
| 3,080,637 | 3/1963 | Dutt | 15/187 |
| 3,603,765 | 9/1971 | Underwood | 132/33 R |
| 3,739,419 | 6/1973 | Natman et al. | 15/201 |
| 3,814,113 | 6/1974 | Morane et al. | 132/36 R |
| 3,968,536 | 7/1976 | Leighton et al. | 15/201 |
| 4,030,158 | 6/1977 | Blair et al. | 15/159 A |
| 4,065,657 | 12/1977 | Zusser | 132/33 R |
| 4,109,667 | 8/1978 | Quirk | 132/33 R |

*Primary Examiner*—Paul J. Hirsch

*Attorney, Agent, or Firm*—Laff, Whitesel & Rockman

[57] ABSTRACT

A heated hair curling brush having a single tubular heating surface and a plurality of comb rings. The comb rings are placed over the heating element. Locking projections on the inner periphery of the comb rings fit into apertures in the surface of the heating surface which hold the comb rings in place. When the brush is assembled there are no interruptions in the exposed portions of the heating surface, and the user's hair may contact the heating surface around the entire circumference of the exposed portions of the heating surface without snagging.

5 Claims, 4 Drawing Figures

HEATED HAIR CURLING BRUSH

The present invention relates to a new and improved heated hair curling brush. More particularly, this invention relates to heated hair curling brushes which have a substantially uninterrupted, one-piece heating surface and a plurality of comb rings which fit around the heating surface, forming a brush.

BACKGROUND OF THE INVENTION

Heated hair curling brushes are generally used as hair styling devices. They include a gripping handle and a brush section. The handle may have means for transmitting line power to the brush section, or may include internal battery means for generating power and transmitting it to the brush section. A switch is usually provided in the handle to control the application of heat. The brush section generally has a heater core or element, a heated surface which contacts the user's hair, and a complement of brush bristles disposed around the heated surface. Power transmitted through the handle generates heat in the heater core, which indirectly heats the surface element.

In using hair curling brushes, hair is curled around the brush section and is heated by the heating surface. The application of heat causes the hair to retain its curl after it has been removed from the brush. The brush bristles are comprised of a relatively non-heat conductive material, and their tips remain relatively cooler than the heated surface element, and properly control the hair as it is curled.

It is desirable to design a brush which provides maximum heat contact with the hair, and does not snag the hair in the brush during use. Present commercially available heated hair curling brushes come in basically two configurations. In one such configuration, the heating surface comprises a series of heat rings, and the brush bristles are on a series of comb rings. The heat rings and comb rings are placed alternately over the heated surface, and are held in place by the handle on one side and a fastener, typically a screw fastener, on the other side. The fit between these parts must be perfect to eliminate any radial cracks around the circumference of the heated surface. If the screw fastener becomes loose for any reason, the rings may separate, and hair may get caught in the radial cracks between them, causing pulling, snagging, and great discomfort to the user.

in another commercially available configuration, the heating surface comprises a series of strips. The brush bristles are also on strips. The heating surface strips and bristle strips are alternately placed around the circumference of the heated surface in an axial direction. Hair is heated at the points where it contacts the heating surface strips. Because the bristle strips interrupt the heating surface strips, however, the hair will never contact the heating element around the entire circumference of the brush section. Thus, maximum energy usage and heating efficiency is not achieved.

OBJECTS OF THE INVENTION

Accordingly, an object of the present invention is to provide a new and improved heated hair curling brush.

Another object is to provide a heated hair curling brush in which hair contacts the heated surface around the entire circumference of exposed areas of the brush section.

Yet another object is to provide a heated hair curling brush in which the hair heating surface is substantially uninterrupted by the brush bristles.

Yet another object is to provide a heated hair curling brush which does not catch or snag hair in the device during use.

Still another object is to provide a heated hair curling brush which may be produced inexpensively and sold to the consumer at a relatively low price.

A further object is to provide a heated hair curling brush capable of heating rapidly, without the need for a heatsink.

SUMMARY OF THE INVENTION

In keeping with one aspect of the invention, a single, substantially uninterrrupted tubular heating surface covers a heater core or element. A plurality of relatively narrow comb rings are disposed over and around the heating surface. Locking projections on the inside of the comb rings fit into apertures in the heating surface, which hold the comb rings in spaced relation on the heating surface. The comb rings fit snugly over the heating surface to form a brush which will not catch the hair of the user and has a high percentage of hair contacting heating surface.

BRIEF DESCRIPTION OF THE DRAWINGS

The above mentioned and other features of this invention and the manner of obtaining them will become more apparent, and the invention itself will be best understood by referring to the following description of an embodiment of the invention taken in conjunction with the accompanying drawings, in which.

DESCRIPTION OF THE PREFERRED EMBODIMENT

Figure 1:
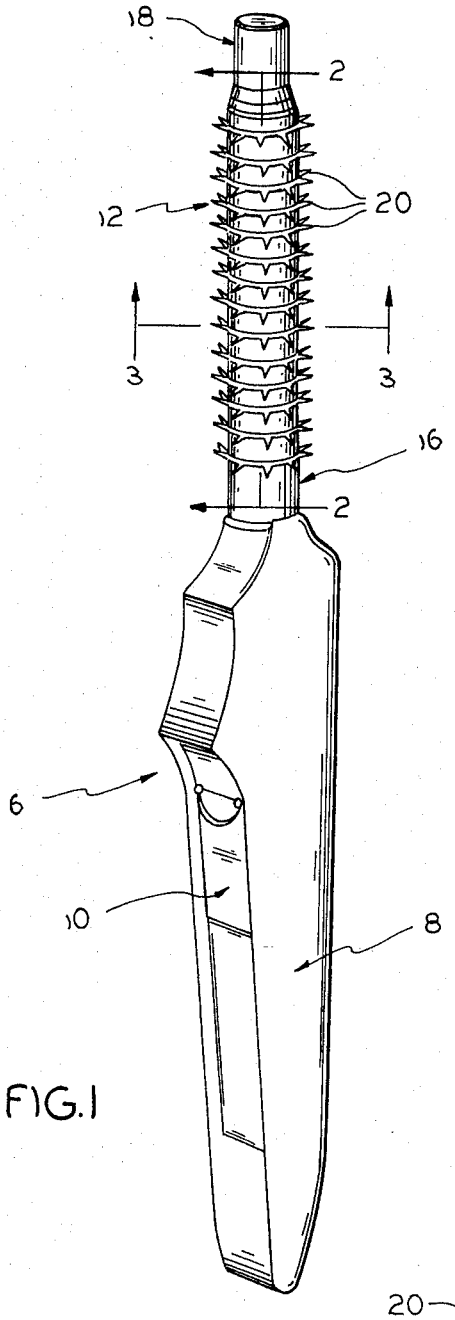
FIG. 1 is a perspective view of an embodiment of a heated hair curling brush constructed in accordance with the present invention.

Referring to FIG. 1, a heated hair curling brush 6 has a handle 8 and a brush section 12. A switch 10 is provided in handle 8 for controlling heating power to brush section 12. Power can be provided by either outside sources such as A-C line current, or internal batteries preferably located in handle 8. Heat generated in the brush section 12 is transmitted to a heating surface 16, which is of one-piece tubular construction and made of a relatively high heat-conductive material. A plurality of comb rings 20 are fixed in spaced relation around the heating surface 16 in a manner to be described. Decorative cap 18 seals the end of brush section 12 opposite handle 8.

Figure 2:
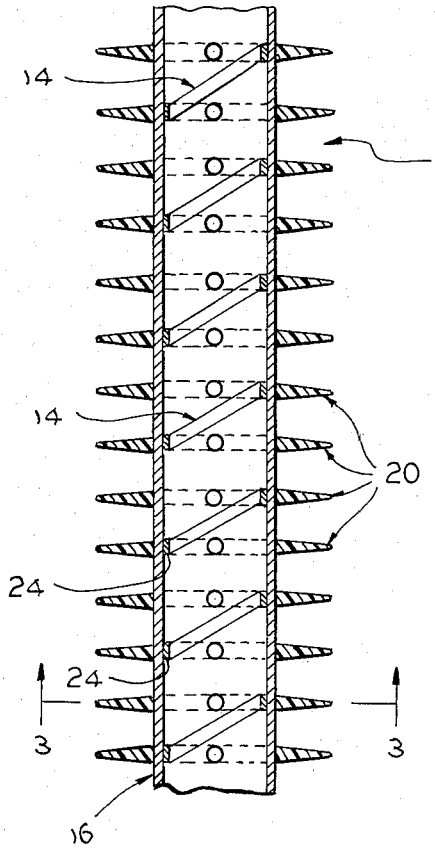
FIG. 2 is an axial cross-sectional view of the brush of FIG. 1 taken along line 2—2.
Figure 3:
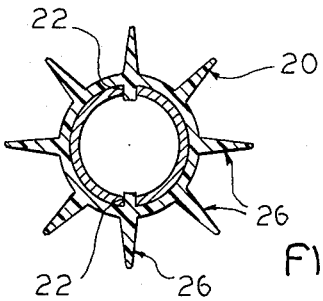
FIG. 3 is a radial cross-sectional view of the comb ring and heating surface of the present invention taken along line 3—3 of FIG. 1.

FIG. 2 discloses details of the construction of brush section 12. Heating surface 16 is interrupted only by a series of apertures 22 spaced along its surface. Locking projections 24 on the internal circumference of each comb ring 20 (FIGS. 3, 4) extend into apertures 22, which hold the comb rings 20 in place on heating surface 16. When the comb rings 20 are in place on heating surface 16, no gaps or breaks in the brush section 12 are exposed which may snag the user's hair. Also, the entire circumference of the exposed portions of heating surface 16 contacts the user's hair.

A heater core or element 14 is disposed inside heating surface 16, and is connected to a source of energy, such as A-C line current or batteries located in handle 8. Switch 10 controls the generation of heat in element 14, which heat is transmitted to heating surface 16. Good heat conductivity is achieved by using material for heating surface 16 such as metal or any suitable material, and by making the heating surface 16 of substantially uninterrupted, one-piece construction. The comb rings 20, which are relatively narrow, fit snugly over the heating surface 16, and are preferably made of relatively poor conductors of heat, such as plastic, or any similar material.

Figure 4:
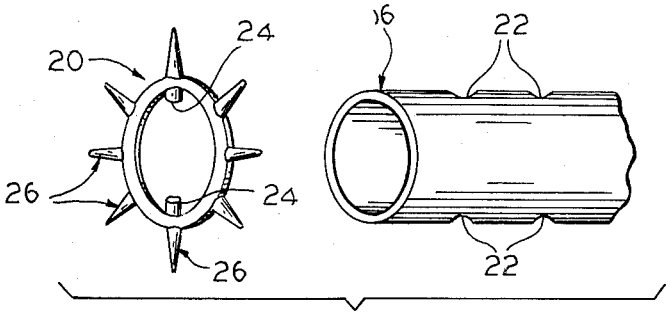
FIG. 4 is an exploded perspective view of a comb ring and a portion of the heating surface of the present invention.

FIG. 4 illustrates details of the construction of comb rings 20. The inside diameter of each comb ring 20 is approximately the same size as the outside diameter of heating surface 16. Bristle-like points 26 are provided around the outer circumference of each ring for brushing, curling and controlling the user's hair. In addition, one or more locking projections 24 are provided on the inner periphery of each comb ring 20. The locking projections 24 (FIG. 3) fit into apertures 22 disposed in spaced relation on the heating surface 16, which holds the comb rings 20 in place on heating surface 16.

The brush section 12, as shown in FIGS. 1 and 4, is assembled by stretching or distorting comb rings 20 and placing them axially along heating surface 16 (FIG. 4) until locking projections 24 snap into place in apertures 22. Stretching can be accomplished by various known means. If the plastic is pliable, a mechanical stretcher can be used. Heating the rings, such as by a hot air blower, or soaking the rings in hot water may also soften the material, or temporarily enlarge the rings, making them easier to apply on heating surface 16. During assembly, it is preferred that the rings 20 are initially placed on heating surface 16 such that the locking projections 24 do not enter the apertures 22 in the heating surface. When the rings 20 are adjacent their proper position, they are turned until the locking projections 24 lock into the appropriate apertures 22, thereby preventing the rings 20 from rotating or moving on heating surface 16. The rings 20 are relatively narrow and are spaced such that the distance between the end surface of each ring 20 on heating surface 16 is approximately equal to or greater than the width of each comb ring. This configuration increases the percentage of heating surface which contacts the user's hair, and thus increases the efficiency of operation of the subject hair curling device. In the preferred embodiment the exposed heating surface distance between each comb ring is approximately equal to or greater than the width of the comb ring. Comb rings of $\frac{1}{8}''$ or less in width have proven successful.

The many advantages of this heated hair curling brush are self-apparent. First, the parts are easily and inexpensively made and assembled. Second, the heating surface may be of smooth one-piece construction, with virtually no interruptions, or radial cracks present on the heating surface to grab or snag the user's hair when the brush section is assembled. Third, the user's hair contacts the heating element around the entire circumference of the brush section wherever the heating surface is exposed to the user's hair. This increases the efficiency of heat transfer to the hair of the user.

While the principles of the invention have been described above in connection with specific apparatus and applications, it is to be understood that this description is made only by way of example and not as a limitation on the scope of the invention.

I claim:

1. A heated hair curling brush comprising:

a handle;

a brush section attached to said handle; and means comprising a source of power;

the brush section comprising a tubular member having a heating surface on the outside thereof, heating element means in direct contact with the inside surface of said tubular means and energized by said power source, a plurality of comb rings placed in spaced relation over said heating surface of said tubular means; said heating surface having no exposed interruptions, between said comb rings, and each said comb ring having one or more brush bristle-like points extending around the periphery thereof.

2. The heated hair curling brush of claim 1 wherein said heating surface includes a plurality of apertures located in spaced relation along the length of said heating surface, and said comb rings having corresponding locking projections which fit into said apertures, thereby holding said comb rings in spaced relation.

3. A heated hair curling brush comprising a handle;

a source of power;

a brush section attached to said handle;

means associated with said handle for switching and transmitting power from said source of power to said brush section;

said brush section including a heater core connected to said source of power and adapted to generate heat, a heating surface associated with and heated by said heater core, a series of apertures disposed in spaced relation along the length of said heating surface, a plurality of comb rings disposed over and around said heating surface, each comb ring having a plurality of brush bristles extending around the periphery thereof, and locking projections on the inside periphery of each of said combs rings adapted to fit in said apertures in said heating surface and hold said comb rings in spaced relation on said heating surface.

4. A comb device for a heated hair brush comprising:

a heater having a thin metal tube enclosing a heating element in direct contact therewith for generating heat at the outside and heating surface thereof; and a plurality of comb rings disposed over and around said heating surface of said tube, said comb rings being distributed in spaced relation along the length of said heating surface, each of said comb rings having a plurality of brush bristle-like points extending around the periphery thereof, said heated surface being uninterrupted between said comb rings, whereby hair wrapped around said tube comes into direct contact with the heating surface of said thin metal tube.

5. The comb device of claim 4 wherein said heating surface includes a plurality of apertures located in spaced relation along the length of said heating surface, and said comb rings include corresponding locking projections which fit into and completely cover said apertures, thereby holding said comb rings in spaced relation along said heating surface.

* * * * *